US012535299B2

(12) United States Patent
Arkin

(10) Patent No.: US 12,535,299 B2
(45) Date of Patent: Jan. 27, 2026

(54) EXPLOSIVE-ACTUATED PERSONAL ARMOR WITH INTEGRATED MULTIMODAL SENSOR SYSTEM AND DEPLOYABLE PROTECTIVE HOOD FOR DEFLECTING PROJECTILES AND PROTECTING THE WEARER

(71) Applicant: Jed Arkin, Gaithersburg, MD (US)

(72) Inventor: Jed Arkin, Gaithersburg, MD (US)

( * ) Notice: Subject to any disclaimer, the term of this patent is extended or adjusted under 35 U.S.C. 154(b) by 0 days.

(21) Appl. No.: 18/915,819

(22) Filed: Oct. 15, 2024

(65) Prior Publication Data

US 2025/0123080 A1 Apr. 17, 2025

Related U.S. Application Data

(60) Provisional application No. 63/590,264, filed on Oct. 13, 2023.

(51) Int. Cl.
*F41H 1/02* (2006.01)
*F41H 5/007* (2006.01)
*F41H 13/00* (2006.01)

(52) U.S. Cl.
CPC ..... *F41H 1/02* (2013.01); *F41H 5/007* (2013.01); *F41H 13/00* (2013.01)

(58) Field of Classification Search
CPC ..... F41H 1/02; F41H 5/007; F41H 13/00
USPC ..... 89/36.17
See application file for complete search history.

(56) References Cited

U.S. PATENT DOCUMENTS 6,012,162 A * 1/2000 Bullat ..... F41H 1/02 2/2.5
6,029,558 A * 2/2000 Stevens ..... F41H 5/007 89/36.17
6,474,213 B1 11/2002 Walker et al.
6,595,102 B2 7/2003 Stevens et al.
7,654,185 B1 2/2010 Yannone
(Continued)

FOREIGN PATENT DOCUMENTS

WO 2006/137048 A2 12/2006
WO 2020/148732 A1 7/2020

OTHER PUBLICATIONS

Ahronheim, 2022, Israeli tech: This new sensor can detect incoming fire on battlefield; The Othello-P passive high-performance gunfire detection system increases survivability and lethality of troops on the battlefield, Published: Jun. 9, 2022, updated: Jun. 9, 2022, Israel News—The Jerusalem Post.
(Continued)

*Primary Examiner* — Bret Hayes
(74) *Attorney, Agent, or Firm* — Brown Rudnick LLP; Matthew P. York

(57) ABSTRACT

A body armor vest system including a wearable vest, a power source, a processor, at least one explosive charge, a multimodal sensor system and an inflatable protective hood, the power source, the processor and the explosive charge positioned on the wearable vest, the inflatable protective hood positioned on an upper portion of the wearable vest, the multimodal sensor system detecting the incoming projectile, the processor determining if the incoming projectile is a credible threat and deploying the inflatable protective hood and detonating the explosive charge if the detected incoming projectile is determined to be a credible threat.

18 Claims, 3 Drawing Sheets

(56) References Cited

U.S. PATENT DOCUMENTS

| | | | | |
|---|---|---|---|---|
| 8,316,753 | B2 | 11/2012 | Beach et al. | |
| 8,464,949 | B2 | 6/2013 | Namey et al. | |
| 10,001,346 | B2 * | 6/2018 | Augustine | F41H 1/00 |
| 10,969,484 | B2 | 4/2021 | Alameri et al. | |
| 2006/0225180 | A1 * | 10/2006 | Ben-Simhon | F41H 5/007 2/6.6 |
| 2007/0180983 | A1 * | 8/2007 | Farinella | F41H 5/026 89/36.17 |
| 2008/0291075 | A1 | 11/2008 | Rapanotti | |
| 2010/0142328 | A1 | 6/2010 | Beck et al. | |
| 2012/0275272 | A1 | 11/2012 | Mullen et al. | |
| 2017/0360122 | A1 * | 12/2017 | Chin | F41H 5/0492 |
| 2022/0325985 | A1 | 10/2022 | Mullen | |

OTHER PUBLICATIONS

Murray, 2017, Bullet Detection and Trajectory Estimation Using a Single Camera, A Thesis Submitted to the Graduate Faculty of George Mason University in Partial Fulfillment of the Requirements for the Degree of Master of Science Computer Science, 76 pages.

* cited by examiner

EXPLOSIVE-ACTUATED PERSONAL ARMOR WITH INTEGRATED MULTIMODAL SENSOR SYSTEM AND DEPLOYABLE PROTECTIVE HOOD FOR DEFLECTING PROJECTILES AND PROTECTING THE WEARER

CROSS-REFERENCE TO RELATED APPLICATION(S)

This application claims the benefit of, and priority to, U.S. Provisional Patent Application No. 63/590,264, filed Oct. 13, 2023, the content of which is incorporated by reference herein in its entirety.

FIELD OF THE DISCLOSED TECHNIQUE

The disclosed technique relates to body armor, in general, and to methods and systems for a body armor vest which utilizes explosive charges combined with a sensor system for displacing a wearer in response to a detected incoming projectile while simultaneously protecting the wearer through the use of a deployable protective hood, thereby reducing the risk of penetration and injury, in particular.

BACKGROUND OF THE DISCLOSED TECHNIQUE

Wearable body armor for protection against incoming projectiles is known in the art. For example, PCT international patent application publication no. WO 2006/137048 A2 to Ben-Simnon, entitled "Reactive Armor", is directed to protective armor for diverting bullets, shrapnel and small shells away from a soldier's helmet and vest and/or away from the skin of vehicles, planes, helicopters and marine vessels. The protective armor consists of a multiplicity of reactive units, which cover the protected object like tiles, with each reactive unit including tiny explosives on one side and parallel hinges opposite to the explosives. The impact of an armament on the protective armor detonates the explosive which in turn rotates the plate and thus diverts the armament away from the protected object.

U.S. Pat. No. 6,474,213 B1 to Walker et al., entitled "Reactive Stiffening Armor System", is directed to a reactive armor structure having an outer layer and a reactive element, comprising a reactive material, adjacent to and integral with the outer layer. Upon impact by a projectile, the reactive material has a detonation velocity effective to produce an amount of pressure that delays and possibly prevents fracture of the outer layer. The reactive element provides an amount of support to the outer layer which is effective to restrain movement of the outer layer when the outer layer is impacted by the projectile.

US patent application publication no. 2010/0142328 A1 to Beck et al., entitled "Projectile-Detection Collars and Methods", is directed to a user-wearable sensor array for use with a projectile-detection system. The sensor array comprises a plurality of sensors configured to detect at least one of sound waves and pressure waves caused by at least one of a muzzle blast and a shockwave of a projectile. The plurality of sensors may be positioned around the collar to provide a 360° detection field-of-view.

U.S. Pat. No. 10,969,484 B2 to Alameri et al., entitled "Bullet Detection System", is directed to a portable and wearable Doppler microwave radar defense system which comprises an array of radar antennas and corresponding feedback units being deployed over a person's body. The system also includes a microcontroller in connection with the array of radar antennas and feedback units for transmitting and receiving microwave signals detected by the antennas. The microcontroller can also process the received microwave signals to determine arrival of a bullet and the associated target location zone on the person's body where the bullet is directed. The microcontroller can further activate at least one feedback unit positioned in the determined target location zone to alert the person. Each feedback unit can include a plurality of sound generators, vibrators and/or electrical shock generators.

Reactive armor for tanks and other military platforms which utilize explosive charges to mitigate the force of incoming projectiles is well known. However, applying similar technology for body armor presents challenges due to the smaller size and higher velocity of bullets and the potential danger of the explosive charges to the wearer.

SUMMARY OF THE PRESENT DISCLOSED TECHNIQUE

It is an object of the disclosed technique to provide a novel method and system for a body armor vest that overcomes the disadvantages of the prior art. The disclosed technique provides a body armor vest that includes a multimodal sensor system for detecting an incoming projectile as well as a plurality of explosive charges that can be detonated upon detection of the incoming projectile. The detonation of the charges is sufficient to move the wearer either through a displacement (such as a lateral displacement) and/or rotation, thereby either moving the wearer completely out of the way of the incoming projectile or causing the incoming projectile to hit the wearer at a glancing angle, thus reducing the risk of penetration of the incoming projectile and injury to the wearer. The disclosed technique also provides an inflatable protective hood which is deployed just before the charges are detonated, thus protecting the wearer's head and neck when moved by the detonated charges. The inflatable protective hood, working in tandem with the multimodal sensor system, can serve as a helmet replacement by providing head and neck protection without requiring explosive displacement.

According to one aspect of the disclosed technique, there is thus provided a body armor vest system including a wearable vest, a power source, a processor, at least one explosive charge, a multimodal sensor system and an inflatable protective hood. The power source, processor and explosive charge are positioned on the wearable vest, with the inflatable hood being positioned on an upper portion of the wearable vest. The explosive charge, the multimodal sensor system and the inflatable hood are coupled with the processor, with the power source also being coupled with the processor. The multimodal sensor system is for detecting at least one incoming projectile. The processor determines if the incoming projectile is a credible threat and deploys the inflatable protective hood and detonates the explosive charge if the detected incoming projectile is determined to be a credible threat.

According to another aspect of the disclosed technique, there is thus provided a body armor vest system including a wearable vest, a power source, at least one explosive charge, a multimodal sensor system, an inflatable protective hood and a processor. The explosive charge and the power source are positioned on the wearable vest, with the inflatable protective hood being positioned on an upper portion of the wearable vest. The explosive charge is coupled with the power source and the processor is wirelessly coupled with the multimodal sensor system, the inflatable protective hood and the explosive charge. The multimodal sensor system is for detecting at least one incoming projectile. The processor determines if the incoming projectile is a credible threat and deploys the inflatable protective hood and detonates the explosive charge if the incoming projectile is determined to be a credible threat.

According to a further aspect of the disclosed technique, there is thus provided a body armor vest system including a wearable vest, a power source, a processor, a multimodal sensor system and an inflatable protective hood. The power source and the processor are positioned on the wearable vest, with the inflatable protective hood being positioned on an upper portion of the wearable vest. The processor is coupled with the power source and the multimodal sensor system and the inflatable protective hood are coupled with the processor. The multimodal sensor system is for detecting at least one incoming projectile. The processor determines if the incoming projectile is a credible threat and deploys the inflatable protective hood if the incoming projectile is determined to be a credible threat.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

Figure 1:
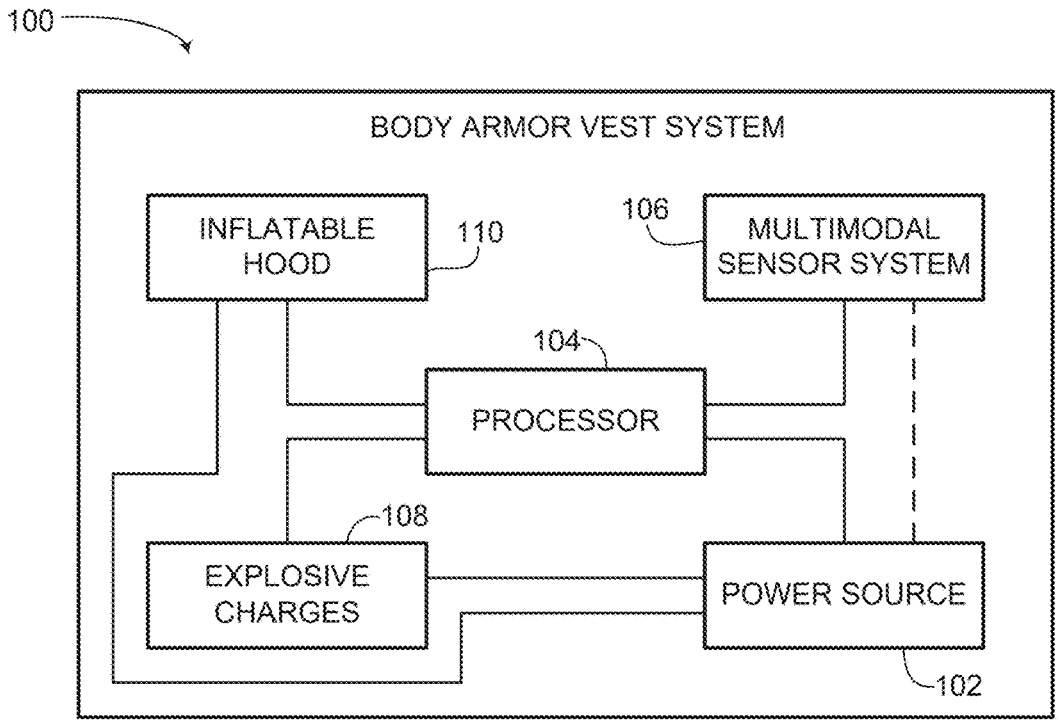
FIG. 1 is a schematic illustration of a body armor vest system, constructed and operative in accordance with an embodiment of the disclosed technique.

The disclosed technique overcomes the disadvantages of the prior art by providing a novel approach to body armor vests. Instead of assuming that a body armor vest will sustain the impact of an incoming projectile or assuming that the body armor vest can be used to move and/or deflect the incoming projectile, according to the disclosed technique, upon detection of an incoming projectile through the aid of an integrated sensor system, the wearer of the body armor vest is moved through an explosive charge embedded in the body armor vest while also being protected from the detonation via an inflatable protective hood. In general, the inflatable protective hood may be deployed just before the explosive charge is detonated for moving the wearer, with the inflatable protective hood being deployed by a separate explosive charge. The body armor vest includes an integrated multimodal sensor system for real-time detection of incoming projectiles. Upon detecting an incoming projectile, the body armor vest triggers the embedded explosive charges, which depending on their placement and directionality can either displace the wearer backward, forward or rotationally. The displacement of the wearer can thus cause the incoming projectile to either avoid the wearer or strike the wearer at a glancing angle, thereby reducing penetration risk of the incoming projectile.

Thus unlike the prior art wherein the primary modus for protecting a platform or an individual from an incoming projectile is to attack the incoming projectile, according to the disclosed technique, the primary modus is to move the target (such as a soldier) out of the path of the incoming projectile through the use of at least one explosive charge. Thus according to the disclosed technique, a system is provided which moves military assets, such as soldiers or security personnel, which are small enough to be moved out of the path of an incoming projectile, through the use of a small blast. This is unlike larger military assets, such as tanks, which are too heavy to be safely moved out of the path of an incoming projectile through the detonation of an explosive charge.

The disclosed technique can be described as a personal armor system which includes a wearable vest fitted with explosive charges, an integrated multi-modal sensor system and an inflatable protective hood having its own explosive charges for immediate deployment of the hood. The integrated multi-modal sensor system enables the personal armor system to accurately detect incoming threats whereas the explosive charges and the inflatable protective hood enable the personal armor system to respond to incoming threats while protecting the wearer. The plurality of explosive charges may be positioned around the wearable vest or may be set up as a centralized charge with a network of valves, tubes and nozzles for guiding the explosive force in a specific direction, depending on the orientation of the wearer and the speed and trajectory of the incoming projectile. Explosives such as sodium azide or guanidine nitrate can be used as the explosive charge due to their rapid gas expulsion properties. Smaller quantities of sodium azide or guanidine nitrate can also be used to rapidly inflate the protective hood due to their rapid gas expulsion properties. The personal armor system also includes a processor for amalgamating the sensed and detected data from the integrated multi-modal sensor system, deciding upon which explosive charge or charges should be detonated and activating the inflatable protective hood just before explosive charges for moving the wearer are detonated. The processor may also be located on an external platform for amalgamating the sensed and detected data from the integrated multi-modal sensor system. Once a determination is made to detonate an explosive charge, the processor only sends triggering data to the personal armor system to detonate the appropriate explosive charge. The inflatable protective hood may be rigidly coupled with the wearable vest such that when explosive charges are detonated for displacing the wearer, the wearable vest and inflatable protective hood rotate and move in the same direction and orientation, thus preventing any whiplash the wearer might experience when the explosive charges are detonated.

According to another embodiment of the disclosed technique, the personal armor system includes a wearable vest fitted with an integrated multi-modal sensor system and an inflatable protective hood. In this embodiment, the personal armor system does not include explosive charges for displacing the wearer and instead only includes the inflatable protective hood combined with the integrated multi-modal sensor system for functioning as a helmet replacement. In this embodiment, explosive charges may still be part of the personal armor system, being used exclusively for inflating and deploying the protective hood. Upon detection of an incoming projectile via the integrated multi-modal sensor system, the inflatable protective hood expands to protect the head and neck of the wearer. In this embodiment, the inflatable protective hood may optionally be rigidly coupled with the wearable vest such that once expanded, the inflatable protective hood maintains the same orientation of the wearable vest. However this is merely an option for this embodiment and not a requirement.

The integrated multi-modal sensor system along with the processor is used to quickly and in real-time determine if a detected threat is a credible threat and if the credible threat is approaching the wearable vest. As described in further detail below, detection of a threat can be achieved using a plurality of sensors which can determine if an incoming projectile is in the vicinity of the wearable vest, such as through acoustic sensors, laser detection sensors, various wave detectors as well as both visible and infrared detectors. A detected threat can be determined to be a credible threat that is approaching the wearable vest through tracking of the trajectory of the incoming projectile. Determination of the trajectory and, accordingly, classification as a credible threat, can be achieved using Doppler microwave radar, millimeter wave detection as well as laser detection, as is known in the prior art, such as in U.S. Pat. No. 8,464,949 B2 and other similar prior art references.

It is noted that throughout this description the term "body armor vest" is used to describe the disclosed technique however that term is synonymous with other terms used in the field such as "bulletproof vest", "personal body armor", "user-wearable vest", "ballistic vest" and "bullet-resistant vest". In addition, the term "incoming projectile" is used to describe any type of ballistic armament or munition which can be used against a person for inflicting damage and injury, such as bullets, sniper bullets, grenades, rocket-propelled grenades, missiles and the like. Furthermore, the term "torso" is used to describe the upper section of a person's body between the waist and the neck, with "upper torso" referring to a person's chest and "lower torso" referring to a person's abdomen. The general term "head" is used to describe both the head and the neck.

Reference is now made to FIG. 1, which is a schematic illustration of a body armor vest system, generally referenced 100, constructed and operative in accordance with an embodiment of the disclosed technique. Body armor vest system 100 includes a power source 102, a processor 104, a multimodal sensor system 106, a plurality of explosive charges 108 and an inflatable protective hood 110. Power source 102 is coupled with processor 104, plurality of explosive charges 108 and inflatable protective hood 110. Power source 102 can optionally be coupled with multimodal sensor system 106 as well. Processor 104 is further coupled with multimodal sensor system 106, plurality of explosive charges 108 and inflatable protective hood 110. All of power source 102, processor 104, multimodal sensor system 106, plurality of explosive charges 108 and inflatable protective hood 110 are integrated into a body armor vest (not shown) and can be sewn, woven or otherwise attached to the body armor vest. Body armor vest system 100 can optionally include a triggering mechanism (not shown), coupled between processor 104 and plurality of explosive charges 108 and inflatable protective hood 110. The triggering mechanism may also be coupled with power source 102. It is noted that in one embodiment, body armor vest system 100 may be decentralized such that processor 104 may be located on an external platform. In such an embodiment body armor vest system 100 may include a transceiver (not shown) for enabling multimodal sensor system 106 and processor 104 to communicate wirelessly with one another. Inflatable protective hood 110 may include its own explosive charges for deployment.

Power source 102 provides power to the various components of body armor vest system 100, thus providing power to processor 104 for processing information received from multimodal sensor system 106. Power source 102 also provides the charge needed to detonate plurality of explosive charges 108 if a threat is detected and detonation is required in order to move the wearer of the body armor vest out of the direct line-of-fire of an incoming projectile (not shown). Power source 102 further provides either the charge or electricity needed to deploy and inflate inflatable protective hood 110, for example through a chemical or physical reaction, such as the detonation of dedicated explosive charges for deploying the protective hood. Depending on the construction of multimodal sensor system 106, power source 102 can also provide power to any of the sensors therein (described below in FIG. 2) which require an active source of power. As described below in FIG. 2, multimodal sensor system 106 is an integrated system and includes a plurality of sensors for detecting incoming projectiles that might be a threat to the wearer of the body armor vest. The plurality of sensors can be passive sensors, active sensors or a combination of the two. In general, passive sensors do not require a source of power whereas active sensors do. Thus, power source 102 only needs to provide power to multimodal sensor system 106 if it includes active sensors. Power source 102 can be embodied as any kind of standalone power source, being either rechargeable or non-rechargeable (i.e., one-time use). As a rechargeable power source, power source 102 can be embodied as a nickel-cadmium (NiCd) battery, a nickel-metal hydride (NiMH) battery, a lithium-ion (Li-ion) battery, a lithium-iron-phosphate ($LiFePO_4$) battery and the like. Other rechargeable power sources are also possible embodiments of power source 102.

Figure 2:
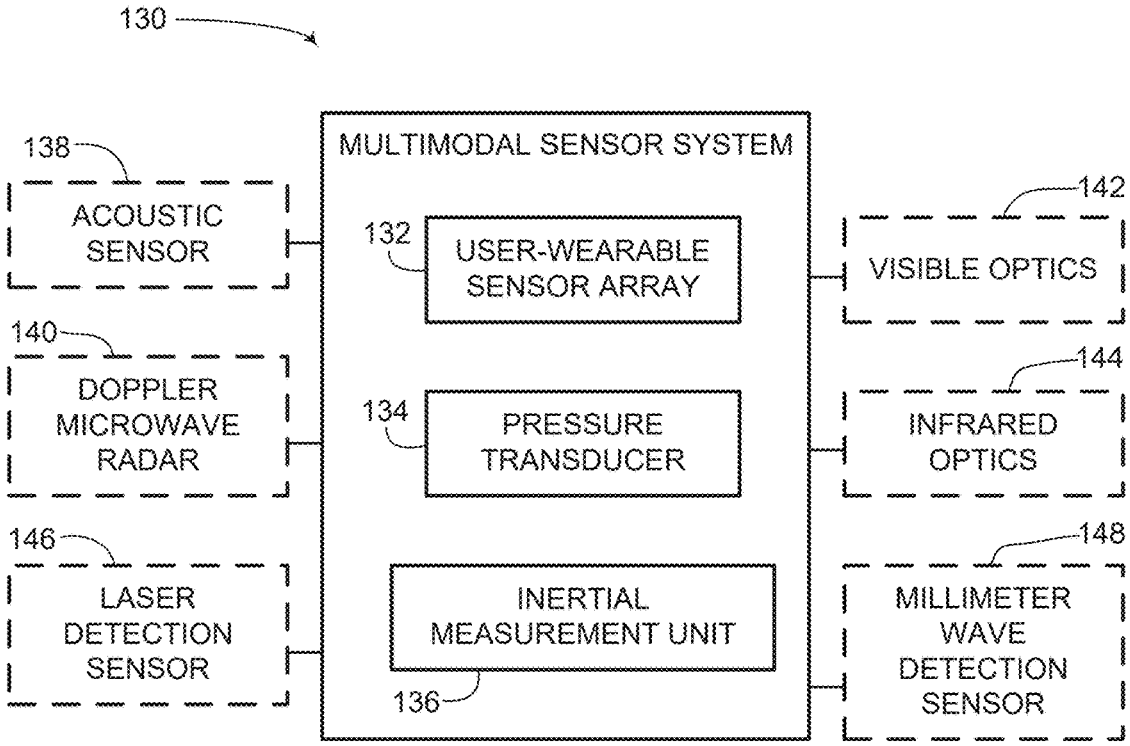
FIG. 2 is a schematic illustration of the multimodal sensor system of FIG. 1, constructed and operative in accordance with another embodiment of the disclosed technique.

Multimodal sensor system 106 can be embodied as any sensor system capable of detecting incoming projectiles, including detecting the parameters required to determine the direction of an incoming projectile as well as the probability that the incoming projectile will impact and hit the wearer of the body armor vest, thus being a threat to the wearer. Since incoming projectiles may travel at very high speeds (for example, faster than the speed of sound), multiple sensors and multiple sensor types may need to be employed together (and thus integrated) in order to determine in real-time that an incoming projectile is heading towards the wearer of the body armor vest. These sensors can include: Doppler radar sensors, visible light sensors, infrared sensors, acoustic sensors, pressure transducers, inertial measurement units, laser range sensors, millimeter wave sensors and the like. FIG. 2 below describes a number of examples of sensors and sensor types which together can form an integrated multi-modal sensor system for detecting incoming projectiles however the disclosed technique is not limited to the sensors described in the multimodal sensor system of FIG. 2. As mentioned above, any multimodal sensor system capable of detecting an incoming projectile can be used to embody multimodal sensor system 106.

Processor 104 receives all the sensed information from multimodal sensor system 106 and processes the sensed information to determine if a detected incoming projectile is indeed a potential, or credible threat to the wearer of the body armor vest or not. The processing of processor 104 can also include a determination of the direction of the incoming projectile and where it may impact and hit the body armor vest. If a potential or credible threat is determined, processor 104 can also determine which of the plurality of explosive charges should be detonated in order to most effectively move and displace the wearer of the body armor vest out of the line-of-fire of the incoming projectile. Once such a determination is made, processor 104 may provide a signal (such as a triggering signal or to a triggering mechanism) to power source 102 to send a charge to specific explosive charges placed around the body armor vest (explained and described in greater detail below in FIGS. 5A and 5B) in order to move the wearer out of the line-of-fire of the incoming projectile. In addition, once a determination is made that the incoming projectile is a credible threat, processor 104 can send an additional signal to power source 102 to provide a charge or electricity to inflatable protective hood 110 to cause a reaction therein to inflate inflatable protective hood 110. In general, once a determination is made that the incoming projectile is a credible threat, the signal to inflatable protective hood 110 is provided just before the signal to plurality of explosive charges 108. Thus the determination of a credible threat from multimodal sensor system 106 will cause processor 104 to provide a signal to power source 102 to activate at least one explosive charge as well as to inflate the inflatable protective hood to protect the wearer of the body armor vest from any possible collateral damage due to the detonation of at least one explosive charge. In the embodiment described above including a triggering mechanism, upon determination of an incoming projectile as a credible threat, processor 104 may provide a signal to the triggering mechanism to trigger both inflatable protective hood 110 and plurality of explosive charges 108.

As mentioned above, processor 104 may be situated on a different physical platform than the rest of the components of body armor vest system 100. For example, power source 102, multimodal sensor system 106, plurality of explosive charges 108 and inflatable protective hood 110 may be located on a wearable vest (not shown) worn by a wearer (such as a soldier) whereas processor 104 may be located on a vehicle (not shown) or platform (not shown) adjacent to the wearer. In this embodiment, as mentioned above, body armor vest system 100 may include a transceiver (not shown) such that multimodal sensor system 106 can transmit information and data it has detected to processor 104 for determining if an incoming projectile is indeed a threat and if so, which one of plurality of explosive charges 108 should be detonated. Processor 104 would then send only a triggering signal back to the transceiver which would then be provided to power source 102 for detonating at least a given one of the plurality of explosive charges 108.

Plurality of explosive charges 108 are positioned around the body armor vest (shown more in detail in FIGS. 3, 5A and 5B below) and contain sufficient charge to physically move and displace and/or rotate an adult human upon detonation. However the amount of charge of plurality of explosive charges 108 is limited such that each charge cannot cause direct internal or external damage to the wearer upon detonation. Stated otherwise, each one of plurality of explosive charges 108 should contain enough charge to apply a force upon detonation equivalent to an adult human being pushed and/or moved off their feet. Plurality of explosive charges 108 can be embodied as any kind of compound that has rapid gas expulsion properties upon reaction, such as sodium azide ($NaN_3$) or guanidine nitrate ($CH_6N_4O_3$), which both can rapidly expel nitrogen gas. Such compounds, when detonated can provide the necessary force for displacing or rotating an adult human without harmful byproducts. Plurality of explosive charges 108 can be detonated using any known chemical and/or physical reaction which can be initiated by processor 104 and/or power source 102. The positioning of plurality of explosive charges 108 around the body armor vest is such that the charge or charges can be detonated to move the wearer in a particular direction. Whereas movement in cardinal directions can be achieved by the detonation of a single charge, other movement directions of the wearer can be achieved by the detonation of more than one charge. For example, a charge positioned on the front (i.e., anterior) side of the body armor vest and a charge positioned on the left side of the body armor vest, when detonated simultaneously, can cause the wearer to be moved in a diagonal direction which is backwards and right in movement. As mentioned above as well, plurality of explosive charges 108 may also be configured as a single centralized charge with a network of valves, tubes and nozzles for guiding the explosive force to move the wearer in a particular direction. For example, a single explosive charge could be guided through such a network of valves and tubes such that the charge exits via multiple nozzles positioned around the body armor vest to cause lateral and/or rotational movement of the body armor vest.

As mentioned above, each of plurality of explosive charges 108 has sufficient charge to physically move and displace an adult human, however not too much charge to cause direct internal or external damage to the wearer upon detonation. Thus each of plurality of explosive charges 108 upon detonation will not cause the rupture or burning of skin, nor the severing of a limb. However since the wearer of the body armor vest will most probably be physically moved suddenly upon the detonation of at least one explosive charge, secondary damage may be caused to the wearer, in particular to their neck and/or their head. Secondary damage could be caused because of the sudden acceleration, torque and/or displacement of the wearer upon detonation of a charge, such as whiplash to the neck. Body armor vest system 100 thus also includes inflatable protective hood 110 which is positioned on the upper side of the body armor vest, near the head of the wearer. Inflatable protective hood 110 can also be referred to as a deployable airbag hood. Just before detonation of a charge, inflatable protective hood 110 inflates (for example through a dedicated explosive charge for inflating the protective hood) to form an almost complete cocoon around the head of the wearer to protect the wearer from secondary damage to their head and neck. Inflatable protective hood 110 is designed in a manner similar to airbags as used in automobiles and can be made from woven fabrics such as nylon, Kevlar and the like. Upon a chemical and/or physical reaction initiated either by processor 104 and/or power source 102, inflatable protective hood 110 is quickly inflated (for example, in less than 500 milliseconds, in less than 100 milliseconds or even in less than 50 milliseconds) through a rapidly expandable gas. Upon inflation, inflatable protective hood 110 surrounds the head and neck of the wearer and protects the wearer from collateral damage to their head and neck upon being moved and displaced from the detonation of at least one explosive charge for moving the wearer. Inflatable protective hood 110 may be positioned around the collar of the body armor vest, thus forming a 'C' or 'U' around the sides and back of the neck and head of an adult human when inflated.

In order to further protect the wearer, inflatable protective hood 110 may be rigidly coupled with the body armor vest upon inflation such that inflatable protective hood 110 maintains the same direction of movement of the body armor vest. Such a rigid coupling will avoid situations where a detonated charge causes the lower portion of the wearer's body (such as their torso) to move in one direction but the head and neck of the wearer to move in another direction. For example, inflatable protective hood 110 may have expandable rods (not shown) which form a rigid structure that maintain the orientation of the inflatable protective hood locked with the orientation of the body armor vest.

It is noted as well that inflatable protective hood 110 may be used in conjunction with other protective gear that the wearer of the body armor vest might use. For example, the wearer (such as a combat soldier) might be wearing a helmet (not shown) besides the body armor vest. Even though the helmet itself might be sufficient to protect the head of the wearer upon detonation of the explosive charges, inflatable protective hood 110 provides extra protection to the wearer's neck and head and thus can potentially allow for the use of lighter helmets as part of the disclosed technique. Inflatable protective hood 110 may also enable the helmet to remain aligned with the body armor vest (as explained above), thus reducing the risk of whiplash if an explosive charge on the body armor vest is detonated. In addition, according to another aspect of the disclosed technique, a helmet (not shown) can be used directly in conjunction with inflatable protective hood 110 wherein the helmet has reinforced protection, predominantly in the front section (such as through the use of a visor). Thus such a helmet can be used to cover areas of the head of the wearer not protected by inflatable protective hood 110, thereby further adding to the protection of the wearer.

Body armor vest system 100 works as follows when worn by a wearer, such as a combat soldier. Multimodal sensor system 106 constantly senses and detects if potential and/or credible threats in the form of incoming projectiles are arriving in the direction of the body armor vest. In a combat situation where many projectiles may be fired in the direction of the wearer, multimodal sensor system 106 continuously senses and detects various quantities and parameters which are passed to processor 104 for processing. As mentioned above, processor 104 might be located on the body armor vest worn by the combat soldier or may be located on an external platform within the vicinity of the combat soldier. Processor 104 processes the data from multimodal sensor system 106 in real-time and determines if an incoming projectile is a potential and/or credible threat and may impact and hit the wearer of the body armor vest. If such a determination is made, processor 104 then determines which direction the incoming projectile is coming from and determines which of plurality of explosive charges 108 should be detonated to most efficiently move the wearer out of the line-of-fire of the incoming projectile. When at least one of plurality of explosive charges 108 is detonated, processor 104 also sends a signal, either directly or via power source 102, to inflate inflatable protective hood 110 to protect the head and neck of the wearer. As mentioned above, inflatable protective hood 110 may be inflated by a dedicated explosive charge (not shown) for just that purpose.

In one embodiment of the disclosed technique, the components and elements of body armor vest system 100 may be replenishable. Therefore if one of plurality of explosive charges 108 is detonated, the detonated charge can be replenished with a new explosive charge. In addition, inflatable protective hood 110, if inflated, may be deflated and reloaded with the compound used to inflate it. In addition, power source 102 can be recharged and/or replaced with a new power source. In another embodiment of the disclosed technique, body armor vest system 100 may be a one-time use system and thus once an explosive charge is detonated and the inflatable protective hood is inflated, body armor vest system 100 cannot be reused again.

Reference is now made to FIG. 2, which is a schematic illustration of the multimodal sensor system of FIG. 1, generally referenced 130, constructed and operative in accordance with another embodiment of the disclosed technique. Multimodal sensor system 130 includes a user-wearable sensor array 132, a plurality of pressure transducers 134 and at least one inertial measurement unit (herein abbreviated IMU) 136. Multimodal sensor system 130 can also optionally include at least one of the following (which are all shown using dashed lines in FIG. 2): at least one acoustic sensor 138, at least one Doppler microwave radar 140, a visible optics 142, an infrared optics 144, at least one laser detection sensor 146 and at least one millimeter wave detection sensor 148. According to the disclosed technique, a plurality of sensor modalities is used for the purposes of detecting and interpreting potential and/or credible threats to a body armor vest (not shown). As mentioned above, the sensors of multimodal sensor system 130 are strategically integrated into the body armor vest to provide real-time information to the processor (not shown), thereby enabling timely and accurate decisions as to whether the explosive charges should be deployed or not in order to avoid or minimize damage and injury from an incoming projectile.

As shown, user-wearable sensor array 132, plurality of pressure transducers 134 and at least one IMU 136 are physically integrated into the body armor vest. The other sensors which form part of multimodal sensor array 130, including at least one acoustic sensor 138, at least one Doppler microwave radar 140, visible optics 142, infrared optics 144, at least one laser detection sensor 146 and at least one millimeter wave detection sensor 148 can either be physically integrated into the body armor vest as well (or at least some of them can be physically integrated) or they can be positioned in the vicinity of the user (as described below in FIG. 4) on other platforms and/or structures and in communication with the processor (not shown) of the body armor vest system (not shown).

User-wearable sensor array 132 can be embodied as a single sensor array or as a plurality of sensor arrays. The sensor array, which is integrated into the body armor vest, can monitor the proximity of potential and/or credible threats and can thus provide an up-close assessment of potential dangers. Examples of user-wearable sensor array 132 are known in the art, such as those disclosed in WO 2020/148732 A1, US 2010/0142328 A1 and US 2012/0275272 A1. The information from user-wearable sensor array 132 is relayed to the processor for a comprehensive threat evaluation. Plurality of pressure transducers 134, which are also embedded within the body armor vest, can detect changes in pressure and/or force exerted on the body armor vest. Thus they can aid in identifying the impact or near-impact of incoming projectiles with the body armor vest. At least one IMU 136, which is also positioned within the body armor vest, can be used to detect changes in orientation, movement and/or sudden acceleration of the body armor vest. This information can be helpful to the processor for determining the position of the wearer vis-à-vis an incoming projectile and if the wearer is impacted by an incoming projectile.

At least one acoustic sensor 138 can be used to detect sound waves produced by an incoming projectile's trajectory. The signature sound of a gunshot or of an incoming projectile can thus be identified and used to triangulate its origin and probable path. At least one Doppler microwave radar 140 can be used to detect and track fast-moving incoming projectiles (such as bullets and missiles). By measuring the frequency change of a reflected radar signal, at least one Doppler microwave radar 140 can determine the speed of an incoming projectile, thus aiding the processor in assessing the potential threat level of the incoming projectile. Visible optics 142 and infrared optics 144 can both be embodied as optical sensors in different wavelength ranges, with visible optics 142 being a visible light sensor and infrared optics 144 being an infrared sensor. The visible light sensor can be used for imaging the area in the vicinity of the body armor vest. Integrated optical sensors such as visible optics 142 and infrared optics 144 provide imaging capabilities for the body armor vest across both visible and infrared spectrums. Infrared optics 144 in particular can detect heat signatures, thus being crucial in low-visibility conditions for detecting incoming projectiles via their propulsion and heat loss. At least one laser detection sensor 146 and at least one millimeter wave detection sensor 148 can provide precise tracking and measurement capabilities and can be used to measure the distance and velocity of an incoming projectile, thereby improving the threat assessment accuracy of the processor. Thus the detected data by the various sensors which form multimodal sensor system 130 can be used to detect a threat in the vicinity of the wearer of the body armor vest and thus also to determine the probable trajectory of the threat. Determining the probable trajectory of the threat enables a processor of the body armor vest (not shown) to determine if the threat is a credible threat and thus if action should be taken to move the wearer or not out of the trajectory of the detected threat. As mentioned above, each of the sensors and detectors shown as part of multimodal sensor system 130 can provide the data and information they sense to the processor of the body armor vest for processing and determining if a detected incoming projectile is indeed a potential and/or credible threat and if so, from which direction the potential threat is coming towards the wearer of the body armor vest.

Figure 3:
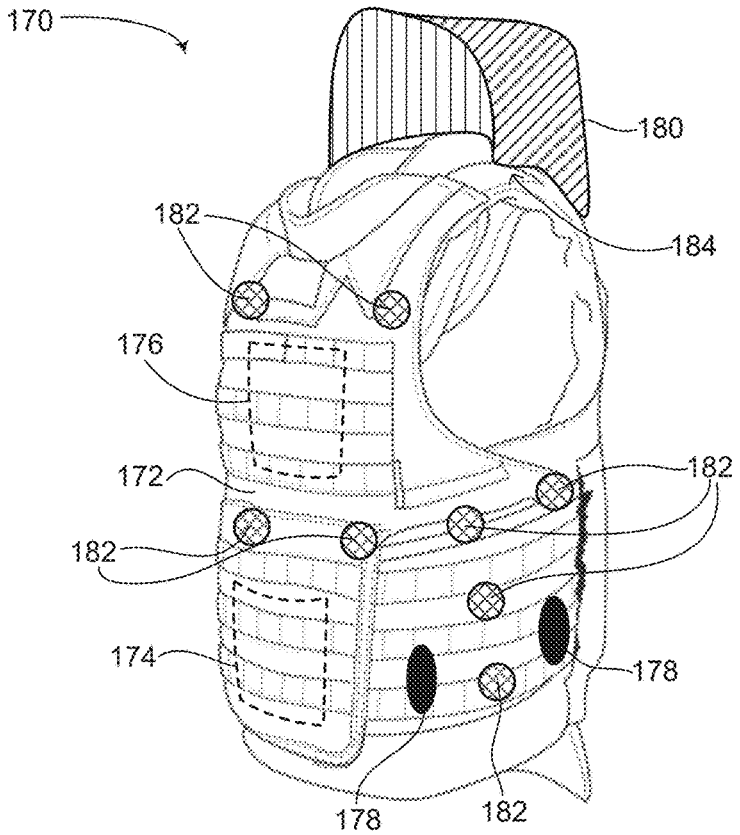
FIG. 3 is a schematic illustration of a body armor vest employing the body armor vest system of FIG. 1, constructed and operative in accordance with a further embodiment of the disclosed technique.

Reference is now made to FIG. 3, which is a schematic illustration of a body armor vest employing the body armor vest system of FIG. 1, generally referenced 170, constructed and operative in accordance with a further embodiment of the disclosed technique. Body armor vest 170 is shown schematically as a tactical vest 172 having various straps and fasteners (both not labeled) for securing the body armor vest to a wearer (not shown). As described below, the particular placement of the elements of body armor vest system 100 (FIG. 1) is merely brought as an example and other configurations of the elements within tactical vest 172 are possible. As shown for example, a lower section of tactical vest 172 can house a power source 174 (equivalent to power source 102 (FIG. 1)) and an upper section of tactical vest 172 can house a processor 176 (equivalent to processor 104 (FIG. 1)). Two explosive charges 178 are shown and are placed laterally on the side of tactical vest 172, with one being positioned towards the front of tactical vest 172 and the other being positioned towards the back of tactical vest 172. Additional explosive charges (not shown) may be positioned on the other side (not viewable) of tactical vest 172 and further explosive charges (also not shown) may be positioned in other locations on tactical vest 172. Power source 174, processor 176 and explosive charges 178 are shown on tactical vest 172 as being positioned on the exterior of tactical vest 172 however this is only for illustrative purposes. Each of these elements can be sewn or woven into tactical vest 172 such that they are not visible when looking at the exterior of tactical vest 172. It is noted as well that wiring may be sewn or woven into tactical vest 172 to electrically couple these elements together, as shown above in FIG. 1. The electrical coupling (not shown) is thus also integrated into tactical vest 172. As mentioned above, processor 176 may be located on an external platform (not shown), with tactical vest 172 including a transceiver (not shown) for wirelessly communicating with processor 176.

An upper section (not labeled) of tactical vest 172 is shown with an inflatable protective hood 180, which is shown as deployed and inflated. As can be seen, once inflated, inflatable protective hood 180 forms a cocoon, 'U' or 'C' shape around the head and neck of the wearer. Before inflation, inflatable protective hood 180 may be positioned in a collar 184 of tactical vest 172. As mentioned above, tactical vest 172 may be used with a helmet (not shown) that includes a visor to protect the face of a wearer, thus together with inflatable protective hood 180, providing completely protective coverage of the head of the wearer and possibly also the neck of the wearer (depending on the size and length of the visor). Multimodal sensor system 106 (FIG. 1) of body armor vest system 100 (FIG. 1) is schematically shown as a plurality of sensors 182 positioned at different locations on tactical vest 172. Each one of plurality of sensors 182 may be the same kind of sensor (for example, each being a pressure transducer) or different kinds of sensors. Tactical vest 172 is shown as having eight sensors as plurality of sensors 182 however any number of sensors can be used with the disclosed technique, and tactical vest 172 may be equipped with tens or even hundreds of sensors which together form multimodal sensor system 106. As mentioned above regarding other elements of tactical vest 172, inflatable protective hood 180 may be coupled via integrated wiring to processor 176 and power source 174. Likewise, plurality of sensors 182 may be coupled with processor 176 and power source 174 (if plurality of sensors 182 includes active sensors) via integrated wiring. Furthermore, depending on the sensor type, plurality of sensors 182 may alternatively be coupled with processor 176 wirelessly.

In one embodiment of the disclosed technique, tactical vest 172 does not include explosive charges 178 for moving and displacing the wearer and inflatable protective hood 180 in tandem with tactical vest 172 functions as a replacement for a helmet. In this embodiment, inflatable protective hood 180 may include at least one dedicated explosive charge for inflating the protective hood. In addition, in this embodiment plurality of sensors 182 function with processor 176 for determining if a threat is coming towards the wearer of tactical vest 172. If such a threat is determined, then processor 176 can send a triggering signal to inflatable protective hood 180 to expand and inflate and substantially protect the head and neck of the wearer from an incoming projectile. As mentioned above, inflatable protective hood 180 may include expandable rods or brackets (both not shown) which rigidly couple inflatable protective hood 180 with tactical vest 172 when inflatable protective hood 180 is inflated. In this embodiment, inflatable protective hood 180 can optionally acts as a rigid cage for the head and neck of the wearer by maintaining the orientation and direction of the head and neck of the wearer of tactical vest 172 with the orientation and direction of tactical vest 172, thus maintaining the body of the wearer in line with their head and neck. This embodiment can aid in preventing head and/or neck injuries to the wearer by preventing any sudden changes of direction of the head of the wearer with respect to their body.

In another embodiment of the disclosed technique, inflatable protective hood 180 includes expandable posts, rods or brackets (all not shown) which rigidly couple inflatable protective hood 180 with tactical vest 172 when inflatable protective hood 180 is inflated, thus maintaining the orientation and direction of the wearer's body with their head and neck. In this embodiment, if explosive charges 178 are detonated, whiplash and possible injury to the wearer's neck can be prevented by maintaining the orientation and direction of the entire upper body of the wearer including their head and neck. If the wearer of tactical vest 172 is also wearing a helmet, the inflation of inflatable protective hood 180 and the detonation of explosive charges 178 could potentially cause serious whiplash and strain on the wearer's neck and head due to the sudden change of movement of the wearer's body from explosive charges 178 in relation to their head and neck. In this embodiment, any sudden movement of the wearer's body will also maintain their head and neck in the same direction when inflatable protective hood 180 is inflated, thus preventing damage and injury, such as whiplash. Thus in this embodiment, inflatable protective hood 180 acts as a rigid cage for the head and neck of the wearer and as it inflates, inflatable protective hood 180 cradles the head and neck of the wearer and holds it rigidly in the same direction of tactical vest 172 just before explosive charges 178 are detonated.

In another aspect of this embodiment, inflatable protective hood 180 can be used in conjunction with a helmet (not shown) that the wearer of tactical vest 172 may wear on their head. As inflatable protective hood 180 inflates around the helmet, inflatable protective hood 180 rigidly couples the helmet with tactical vest 172 thus keeping the head and neck of the wearer in line with their body.

In general, inflatable protective hood 180 should be made from a material that can inflate rapidly like an airbag and enclose the head and neck of the wearer like a helmet. The material should also be strong enough to deflect bullets like a Kevlar vest. Thus for example, inflatable protective hood 180 could be made from inflatable Kevlar which may be able to deflect incoming projectiles at certain incident angles when inflated.

Figure 4:
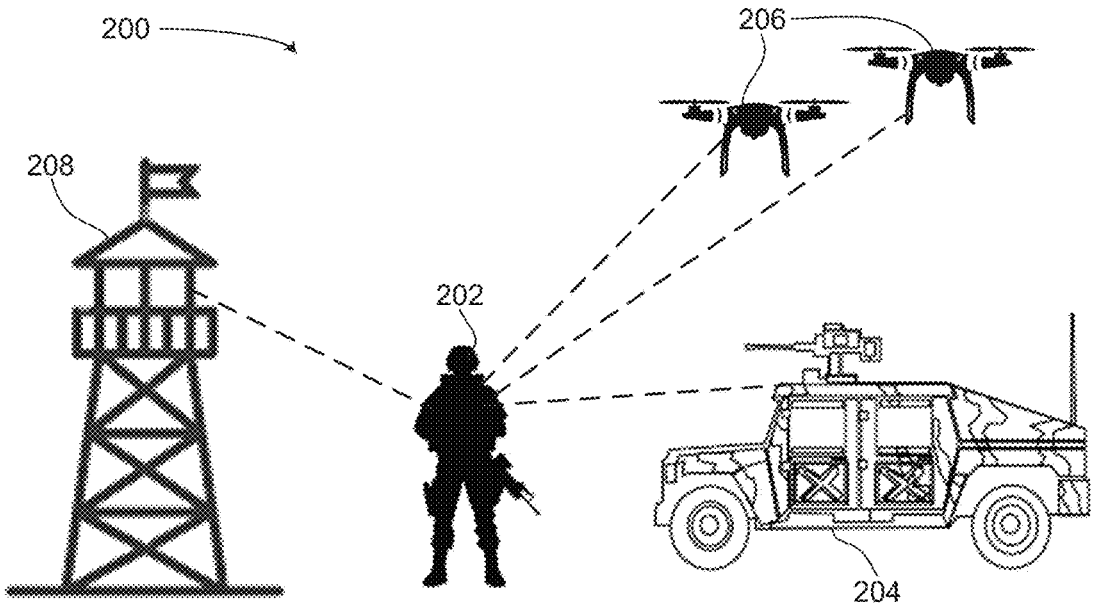
FIG. 4 is a schematic illustration of an extended body armor vest system, constructed and operative in accordance with another embodiment of the disclosed technique.

Reference is now made to FIG. 4, which is a schematic illustration of an extended body armor vest system, generally referenced 200, constructed and operative in accordance with another embodiment of the disclosed technique. Extended body armor vest system 200 diversifies the sensor deployment of the multimodal sensor system of body armor vest system 100 (FIG. 1) by positioning different and/or additional sensors of the multimodal sensor system on various platforms and structures within the vicinity of a wearer of a body armor vest of the disclosed technique. As shown, a combat soldier 202 may be equipped with a tactical vest (not shown) embodying body armor vest system 100. The tactical vest would include the sensors of the multimodal sensor system that are needed to provide immediate data for rapid response and decision making, such as user-wearable sensor array 132, plurality of pressure transducers 134 and at least one IMU 136 (all in FIG. 2). This is because combat soldier 202 is at the forefront of potential threats from incoming projectiles. At least one ground vehicle 204 in the vicinity of combat soldier 202 can be outfitted with at least one sensor array (as described above), thereby serving as a mobile surveillance unit. The at least one sensor array extends the detection range of potential threats and offers additional protection to troops in convoys or patrols. As shown, data from the at least one sensor array on at least one ground vehicle 204 can be relayed wirelessly to the processor (not shown) in the tactical vest of combat soldier 202. In addition, a plurality of drones 206 can also be equipped with at least one sensor array for detecting incoming projectiles and potential threats. The at least one sensor array may include visible and infrared light sensors since plurality of drones 206 can provide an aerial view of a battlefield (not shown). Plurality of drones 206 can thus aid in monitoring the battlefield for sniper positions and/or shooters and as shown, can relay real-time threat data wirelessly to the processor in the tactical vest of combat soldier 202. Furthermore, at least one stationary or mobile tower 208 may be placed strategically in or near the battlefield (as could be any other type of similar structure). At least one mobile tower 208 may house high-powered sensors for providing a broad field-of-view of the battlefield, thus ensuring continuous monitoring of vast areas. As shown, the data from such high-powered sensors can also be wirelessly transferred to the processor in the tactical vest of combat soldier 202.

It is noted as well that additional data from close support manned aircraft in the vicinity of combat soldier 202 can also be used as a source of information for relaying to the processor in the tactical vest of combat soldier 202. It is further noted that in addition to plurality of drones 206 and other platforms in the vicinity of combat soldier 202 which are equipped with sensors for increasing the situational awareness of combat solider 202 and providing relevant data to the processor in the tactical vest of combat soldier 202, according to another embodiment of the disclosed technique, assuming combat soldier 202 is not alone in the field and is part of a platoon or company of combat soldiers (not shown), then tactical vests worn by the other combat soldiers can also be used as sensor nodes for providing information and data to the processor of the tactical vest of combat soldier 202. Thus other tactical vests in the vicinity of combat soldier 202 can be used as sources of information and data for increasing situational awareness and providing information to the tactical vests of combat soldiers regarding potential and/or credible threats and incoming projectiles.

It is noted as well, as mentioned above, that the processor of the tactical vest may be situated on a different platform and can be in wireless communication with the tactical vest for transmitting a triggering signal. Thus, a larger and faster processor (as compared to what combat soldier 202 can reasonably carry on him) may be situated on at least one ground vehicle 204 and/or at least one mobile tower 208 to which sensor data is transferred to for analysis. Thus the tactical vests of a plurality of combat soldiers may communicate all their sensor data to a central processor (not shown) which can integrate all the data collected and provide real-time determination of potential and/or credible threats and incoming projectiles to all the combat soldiers in the vicinity of the central processor.

As shown in FIG. 4, according to the disclosed technique, in order to bolster the efficiency and coverage of the sensors which form part of the multimodal sensor system, the sensors can be deployed beyond just the tactical vest of combat soldier 202. According to another embodiment of the disclosed technique, sensors which require more power and/or energy to function and detect can be positioned in larger elements such as at least one mobile tower 208 and/or at least one ground vehicle 204 instead of being positioned within the tactical vest of combat soldier 202. Likewise, a processor which requires significant power and/or energy to function and is too large to place on a tactical vest, can be positioned in larger elements such as at least one mobile tower 208 and/or at least one ground vehicle 204. The diversified sensor deployment of the multimodal sensor system in this embodiment can be embodied using known diversified sensor arrays, such as those disclosed in Israel Aerospace Industries OTHELLO-P system (https://www.iai.co.il/othello-p-gunfire-detection-system), U.S. Pat. No. 6,595,102 B2, U.S. Pat. No. 7,654,185 B1, U.S. Pat. No. 8,316,753 B2, US 2008/0291075 A1 and US 2022/0325985 A1. Furthermore, the diversified deployment of sensors as shown in FIG. 4 can be used to increase the accuracy of the threat assessment according to the disclosed technique since data from the sensors on all the platforms shown in FIG. 4 can be integrated to make an improved determination of the potential threat to combat soldier 202 of an incoming projectile (not shown). As mentioned above, the processor in the tactical vest of combat soldier 202 can receive sensor data from the various sensors shown in FIG. 4 and in real-time, process and analyze factors such as incoming projectile speed, trajectory, point-of-origin and probable path. Such a comprehensive analysis enhances the determination if an incoming projectile (such as a gunshot) represents a genuine threat to combat soldier 202 or not. As another example, a sniper's gunshot detected by one of plurality of drones 206 can be cross-referenced with parameters detected by the user-wearable sensor array in the tactical vest of combat soldier 202 to ascertain its threat level. If both data points sufficiently agree on the imminent danger, extended body armor vest system 200 can then make an informed decision to detonate at least one of the explosive charges in the tactical vest to displace combat soldier 202 out of the imminent danger. The integrated sensor approach presented in FIG. 4 can also be used to minimize false positives, thereby ensuring that the explosive charges are deployed only when there is a sufficiently high probability of a genuine threat to combat soldier 202. This approach of the disclosed technique thereby conserves resources while maximizing wearer safety.

Figure 5A:
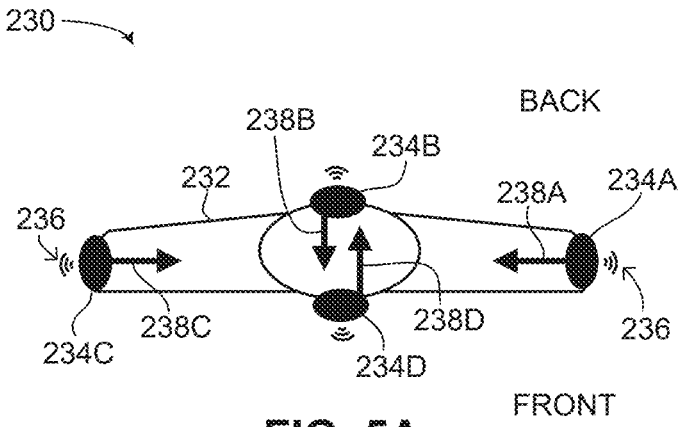
FIGS. 5A and 5B are schematic illustrations of the placement of explosive charges on the body armor vest system of FIG. 1, constructed and operative in accordance with a further embodiment of the disclosed technique.
Figure 5B:
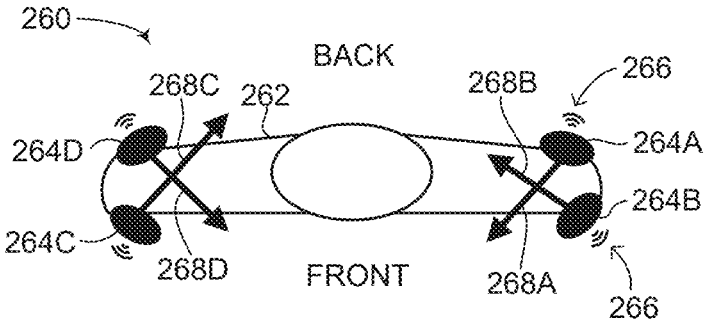

Reference is now made to FIGS. 5A and 5B, which are schematic illustrations of the placement of explosive charges on the body armor vest system of FIG. 1, generally referenced 230 and 260 respectively, constructed and operative in accordance with a further embodiment of the disclosed technique. With specific reference to FIG. 5A, FIG. 5A represents a top orthogonal view of a body armor vest 232, which is similar to body armor vest 170 (FIG. 3), wherein the 'front' and 'back' of body armor vest 232 is marked accordingly. Body armor vest 232 includes a first configuration of how explosive charges can be positioned around the body armor vest. As shown, four explosive charges 234A-234D are positioned at four cardinal positions around body armor vest 232, with explosive charge 234A being placed on the left side (3 o'clock) of body armor vest 232, explosive charge 234B being placed on the back side (12 o'clock) of body armor vest 232, explosive charge 234C being placed on the right side (9 o'clock) of body armor vest 232 and explosive charge 234D being placed on the front side (6 o'clock) of body armor vest 232. A plurality of detonation waves 236 are schematically shown for each one of explosive charges 234A-234D. As is known, even though each explosive charge detonates radially in all directions, given that the explosive charge is integrated into body armor vest 232 and the detonation charge is not sufficient to cause direct damage to the wearer, each explosive charge predominantly causes movement of body armor vest 232 in a particular direction. Thus plurality of detonation waves 236 is shown in the general direction wherein they propagate when a respective explosive charge is detonated. As shown, explosive charge 234A causes a predominantly right direction movement shown by an arrow 238A, explosive charge 234B causes a predominantly forward direction movement shown by an arrow 238B, explosive charge 234C causes a predominantly left direction movement shown by an arrow 238C and explosive charge 234D causes a predominantly backward direction movement shown by an arrow 238D.

As can be understood from the first configuration in FIG. 5A, the detonation of a single explosive charge can be used to displace the wearer of body armor vest 232 in one of the cardinal directions. By detonating two adjacent explosive charges simultaneously, the wearer of body armor vest 232 can be displaced in a diagonal direction. For example, detonating explosive charges 234A and 234B will cause the wearer to be displaced in a forward-right direction (7:30 o'clock), whereas detonating explosive charges 234A and 234D will cause the wearer to be displaced in a backward-right direction (10:30 o'clock). According to one embodiment of the disclosed technique, each one of explosive charges 234A-234D can have varying amounts of explosive materials, for example by each having different compartments each containing a different amount of explosive material. The specific amount of explosive material detonated for a given explosive charge can then be used to move the wearer in a more precise direction upon detonation. For example, if each one of explosive charges 234A-234D has three different compartments with different amounts of explosive material, then simultaneously detonating explosive charge 234A with the most amount of explosive material and detonating explosive charge 234D with the least amount of explosive material would cause the wearer to be displaced in a predominantly right, slightly backward direction (9:45 o'clock), whereas simultaneously detonating explosive charge 234A with the least amount of explosive material and detonating explosive charge 234D with the most amount of explosive material would cause the wearer to be displaced in a predominantly backward, slightly right direction (11:15 o'clock). As should be obvious to the worker skilled in the art, other combinations of amounts of explosive material are possible and thus more precise movement of the wearer is also possible by the detonation of explosive charges. In addition, two or more of explosive charges 234A-234D could be detonated at slightly different times, for example, in increments of 500 milliseconds, thus causing a rotation in body armor vest 232. For example, detonation of opposite facing explosive charges (such as explosive charges 234B and 234D) could cause body armor vest 232 to rotate and thus present a glancing angle to an incoming projectile. In the embodiment of the disclosed technique which includes a triggering mechanism, the triggering mechanism could be timed to trigger different ones of explosive charges 234A-234D within a specific time-frame based on sensed data from the sensors in the multimodal sensor system, thereby ensuring optimal movement (i.e., displacement and/or rotation) of a wearer of body armor vest 232.

With specific reference to FIG. 5B, FIG. 5B represents a top orthogonal view of a body armor vest 262, which is similar to body armor vest 170 (FIG. 3), wherein the 'front' and 'back' of body armor vest 262 is marked accordingly. Body armor vest 262 includes a second configuration of how explosive charges can be positioned around the body armor vest. As shown, four explosive charges 264A-264D are positioned at four diagonal positions around body armor vest 262, with explosive charge 264A being placed on the back-left side (1:30 o'clock) of body armor vest 262, explosive charge 264B being placed on the front-left side (4:30 o'clock) of body armor vest 262, explosive charge 264C being placed on the front-right side (7:30 o'clock) of body armor vest 262 and explosive charge 264D being placed on the back-right side (10:30 o'clock) of body armor vest 262. A plurality of detonation waves 266 are schematically shown for each one of explosive charges 264A-264D, showing that each explosive charge predominantly causes movement of body armor vest 262 in a particular direction. As shown, explosive charge 264A causes a predominantly forward-right direction movement shown by an arrow 268A, explosive charge 264B causes a predominantly backward-right direction movement shown by an arrow 268B, explosive charge 264C causes a predominantly backward-left direction movement shown by an arrow 268C and explosive charge 264D causes a predominantly forward-left direction movement shown by an arrow 268D. As described in FIG. 5A above, a combination of adjacent explosive charges being detonated simultaneously can cause the wearer of body armor vest 262 to move in directions other than the directions shown by arrows 268A-268D. Similar to what was described in FIG. 5A, each one of explosive charges 264A-264D could include multiple compartments with varying levels of explosive material for moving the wearer in a more precise direction upon detonation.

In addition, the configurations as shown above in FIGS. 5A and 5B are merely options and body armor vests 232 and 262 could be equipped with only three explosive charges, five explosive charges, eight explosive charges or another number of explosive charges greater than two. Body armor vests 232 and 262 could also be equipped with a single explosive charge wherein body armor vests 232 and 262 also include a network of valves, tubes and nozzles for directing the charge to particular areas of the body armor vest. Also, the placement of explosive charges around the body armor vest could be in different configurations other than the two configurations shown in FIGS. 5A and 5B. In another embodiment of the disclosed technique, the body armor vest can also be equipped with at least one explosive charge.

According to another embodiment of the disclosed technique, the explosive charges of the body armor vest can be set to intentionally propel the wearer of the body armor vest into the path of an incoming projectile and/or detected potential and/or credible threat. Such an embodiment is useful in circumstances where the wearer of the body armor vest is a security agent or personnel tasked with protecting a high-profile individual, such as a head of state or military leader. In this embodiment, detonation of explosive charges on the body armor vest may be used to sacrificially move the security agent and/or personnel into the path of an incoming projectile in order to protect the life of the head of state or military leader they are supposed to be guarding and protecting.

It will be appreciated by persons skilled in the art that the disclosed technique is not limited to what has been particularly shown and described hereinabove. Rather the scope of the disclosed technique is defined only by the claims, which follow.

The invention claimed is:

1. A body armor vest system comprising:

a wearable vest;

a power source, positioned on said wearable vest;

a processor, coupled with said power source and positioned on said wearable vest;

at least one explosive charge, coupled with said processor and positioned on said wearable vest;

a multimodal sensor system, coupled with said processor, for detecting at least one incoming projectile; and an inflatable protective hood, coupled with said processor, positioned on an upper portion of said wearable vest, wherein said processor determines if said at least one incoming projectile is a credible threat; and wherein said processor deploys said inflatable protective hood and detonates said at least one explosive charge if said detected incoming projectile is determined to be said credible threat.

2. The body armor vest system according to claim 1, further comprising a triggering mechanism, coupled with said processor and said power source, for activating said at least one explosive charge upon said multimodal sensor system detecting said at least one incoming projectile.

3. The body armor vest system according to claim 2, wherein said triggering mechanism is calibrated to activate said at least one explosive charge within a specific time-frame based on sensed data from said multimodal sensor system, thereby ensuring optimal movement of a wearer of said wearable vest.

4. The body armor vest system according to claim 1, wherein said at least one explosive charge moves a wearer of said wearable vest to present a glancing angle to said at least one incoming projectile.

5. The body armor vest system according to claim 4, wherein said moving of said wearer comprises at least one movement selected from the list consisting of:

displacement; and rotation.

6. The body armor vest system according to claim 1, wherein said multimodal sensor system comprises at least one sensor selected from the list consisting of:

a Doppler microwave radar, for tracking fast-moving incoming projectiles;

a visible optics, for imaging in visible lighting conditions;

a infrared optics, for detecting heat signatures;

at least one acoustic sensor, for detecting sound waves produced by said at least one incoming projectile;

a laser detection sensor;

a millimeter wave detection sensor;

a user-wearable sensor array, integrated into said wearable vest;

a plurality of pressure transducers, integrated into said wearable vest, for detecting changes in at least one of a pressure and a force on said wearable vest; and at least one inertial measurement unit, integrated into said wearable vest, for detecting changes in an orientation of said wearable vest.

7. The body armor vest system according to claim 1, wherein a first one of said at least one explosive charge is positioned opposite a second one of said at least one explosive charge for facilitating a rotation of a wearer of said wearable vest.

8. The body armor vest system according to claim 1, wherein said at least one explosive charge is centrally located on said wearable vest, said body armor vest system further comprising a network of at least one of valves, tubes and nozzles, for directing an explosive force of said at least one explosive charge in a given direction.

9. The body armor vest system according to claim 1, wherein said inflatable protective hood when deployed substantially surrounds at least one of a head and a neck of a wearer of said wearable vest.

10. The body armor vest system according to claim 1, wherein said inflatable protective hood is made from a woven material selected from the list consisting of:

nylon; and

Kevlar.

11. The body armor vest system according to claim 1, wherein an explosive material of said at least one explosive charge is selected from the list consisting of:

sodium azide; and guanidine nitrate.

12. The body armor vest system according to claim 1, further comprising a helmet, a front end of said helmet being predominantly reinforced, for protecting at least one area of a wearer of said wearable vest not protected by said inflatable protective hood.

13. The body armor vest system according to claim 1, wherein said multimodal sensor system is deployed over at least one platform.

14. The body armor vest system according to claim 13, wherein said at least one platform is selected from the list consisting of:

at least one drone;

at least one mobile tower;

at least one stationary tower; and at least one ground vehicle.

15. The body armor vest system according to claim 1, wherein said multimodal sensor system is deployed over a plurality of wearable vests.

16. The body armor vest system according to claim 1, wherein said at least one explosive charge moves a wearer of said wearable vest into the path of said at least one incoming projectile.

17. A body armor vest system comprising:

a wearable vest;

a power source, positioned on said wearable vest;

at least one explosive charge, coupled with said power source and positioned on said wearable vest;

a multimodal sensor system, for detecting at least one incoming projectile;

an inflatable protective hood, positioned on an upper portion of said wearable vest; and a processor, wirelessly coupled with said multimodal sensor system, said inflatable protective hood and said at least one explosive charge, wherein said processor determines if said at least one incoming projectile is a credible threat; and wherein said processor deploys said inflatable protective hood and detonates said at least one explosive charge if said at least one incoming projectile is determined to be said credible threat.

18. A body armor vest system comprising:

a wearable vest;

a power source, positioned on said wearable vest;

a processor, coupled with said power source and positioned on said wearable vest;

a multimodal sensor system, coupled with said processor, for detecting at least one incoming projectile; and an inflatable protective hood, coupled with said processor and positioned on an upper portion of said wearable vest, wherein said processor determines if said at least one incoming projectile is a credible threat; and wherein said processor deploys said inflatable protective hood if said at least one incoming projectile is determined to be said credible threat.

* * * * *